US010066640B2

(12) United States Patent
Bennington et al.

(10) Patent No.: US 10,066,640 B2
(45) Date of Patent: Sep. 4, 2018

(54) OPTIMIZED CIRCUMFERENTIAL GROOVE CASING TREATMENT FOR AXIAL COMPRESSORS

(71) Applicant: United Technologies Corporation, Hartford, CT (US)

(72) Inventors: Matthew A. Bennington, East Hampton, CT (US); Kerrin E. Connors, Colchester, VT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 392 days.

(21) Appl. No.: 14/618,730

(22) Filed: Feb. 10, 2015

(65) Prior Publication Data

US 2016/0230776 A1 Aug. 11, 2016

(51) Int. Cl.

| | |
|---|---|
| ***F04D 29/52*** | (2006.01) |
| ***F04D 29/68*** | (2006.01) |
| ***F04D 29/32*** | (2006.01) |
| ***F04D 29/16*** | (2006.01) |
| *F01D 11/08* | (2006.01) |

(52) U.S. Cl.

CPC ..... *F04D 29/526* (2013.01); *F04D 29/164* (2013.01); *F04D 29/321* (2013.01); *F04D 29/685* (2013.01); *F01D 11/08* (2013.01)

(58) Field of Classification Search

CPC .... F04D 29/526; F04D 29/681; F04D 29/685; F05D 2240/11; F05D 2270/101

See application file for complete search history.

(56) References Cited

U.S. PATENT DOCUMENTS

| | | | | |
|---|---|---|---|---|
| 4,063,848 A * | 12/1977 | Wiggins | F04D 27/02 415/172.1 |
| 4,466,772 A * | 8/1984 | Okapuu | F01D 11/08 415/171.1 |
| 5,282,718 A * | 2/1994 | Koff | F01D 11/08 415/57.3 |
| 6,231,301 B1 * | 5/2001 | Barnett | F04D 27/02 415/119 |

(Continued)

FOREIGN PATENT DOCUMENTS

| | | | |
|---|---|---|---|
| EP | 2484913 | 8/2012 | |
| FR | 2558900 A1 * | 8/1985 | F01D 11/08 |

(Continued)

OTHER PUBLICATIONS

Partial European Search Report dated Jun. 28, 2016 in European Application No. 15199323.5.

(Continued)

*Primary Examiner* — Seth W Mackay-Smith
(74) *Attorney, Agent, or Firm* — Snell & Wilmer, L.L.P.

(57) ABSTRACT

A compressor is provided. The compressor includes a rotating member configured to rotate about an axis and a static member radially adjacent the rotating member with a clearance between the static member and the rotating member. A first groove is disposed circumferentially about the static member and radially adjacent the rotating member. A second groove is disposed circumferentially about the static member and a first axial distance aft of the first groove. A third groove is disposed circumferentially about the static member and a second distance aft of the second groove, wherein the first distance is different from the second distances.

20 Claims, 5 Drawing Sheets

(56) References Cited

U.S. PATENT DOCUMENTS 6,234,747 B1 * 5/2001 Mielke ..... F01D 11/08 415/119
6,350,102 B1 * 2/2002 Bailey ..... F01D 5/20 415/173.5
6,832,890 B2 * 12/2004 Booth ..... F01D 5/20 415/173.1
7,210,905 B2 * 5/2007 Lapworth ..... F04D 29/526 415/220
8,602,720 B2 * 12/2013 Goswami ..... F01D 11/08 415/119
8,939,705 B1 * 1/2015 Lee ..... F01D 11/122 415/1
9,004,859 B2 * 4/2015 Shahpar ..... F01D 11/08 415/220
2002/0131858 A1 * 9/2002 Adams ..... F01D 11/08 415/9
2003/0152455 A1 * 8/2003 James ..... F01D 11/122 415/108
2007/0147989 A1 * 6/2007 Collins ..... F01D 11/02 415/173.1
2011/0299979 A1 * 12/2011 Montgomery ..... F01D 5/143 415/182.1
2015/0003976 A1 * 1/2015 Zotz ..... F01D 9/02 415/208.1
2016/0153465 A1 * 6/2016 Yoon ..... F04D 29/526 60/805
2016/0222973 A1 * 8/2016 Reynolds ..... F04D 27/02

FOREIGN PATENT DOCUMENTS

FR 2929349 A1 * 10/2009 ..... F04D 29/164
SU 926365 5/1982

OTHER PUBLICATIONS

Extended European Search Report dated Oct. 14, 2016 in European Application No. 15199323.5.

* cited by examiner

OPTIMIZED CIRCUMFERENTIAL GROOVE CASING TREATMENT FOR AXIAL COMPRESSORS

GOVERNMENT LICENSE RIGHTS

This disclosure was made with government support under contract No. W911W6-08-2-0001 awarded by the United States Army, proposal number P00021. The government has certain rights in the disclosure.

FIELD OF INVENTION

The present disclosure relates to gas turbine engines, and, more specifically, to a circumferential groove compressor case treatment.

BACKGROUND

One potential limiting factor in gas turbine engines may be the stability of the compression system. In that regard, greater stability in the compression system support improved engine operation. The stability of the compression system in a gas turbine engine may be limited by both the engine operating conditions and stall capability of the compressor. In some compressors, the initiation of a stall may be driven by the tip leakage flow through the tip clearance between an airfoil and the outer diameter of the compressor. The detrimental characteristics of tip leakage flow may predominantly be from reverse tip leakage flow, that is, tip leakage flow moving aft to forward.

Alterations to improve compressor stability by increasing the stall margin, for example, typically result in reduced engine efficiency. Casing treatments, such as geometric modifications of the walls of a compressor case, may have resulted in reduced engine efficiency in previous applications.

SUMMARY

A compressor comprises a rotating member configured to rotate about an axis and a static member radially adjacent the rotating member with a clearance between the static member and the rotating member. A first groove is disposed circumferentially about the static member and radially adjacent the rotating member. A second groove is disposed circumferentially about the static member and a first axial distance aft of the first groove. A third groove is disposed circumferentially about the static member and a second axial distance aft of the second groove, wherein the first axial distance is different from the second axial distance.

A fan case configured to enclose an airfoil rotating about an axis comprises a cylindrical wall, and a first groove formed circumferentially on the cylindrical wall. A second groove is formed circumferentially on the cylindrical wall aft of the first groove, and a third groove is formed circumferentially on the cylindrical wall. A length of the third groove is greater than a length of the second groove.

A method of locating a case treatment in a compressor section comprises the steps of identifying a first location of air flow with negative axial velocity near a stall condition, and forming a first circumferential groove through the first location of air flow. The method also includes the steps of identifying a second location of air flow with negative axial velocity near the stall condition, and forming a second circumferential groove aft of the first circumferential groove and through the second location of air flow. The method further comprises the steps of identifying a third location of air flow with negative axial velocity near the primary operating condition, and forming a third circumferential groove aft of the second circumferential groove and through the third location of air flow.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

DETAILED DESCRIPTION

Figure 1:
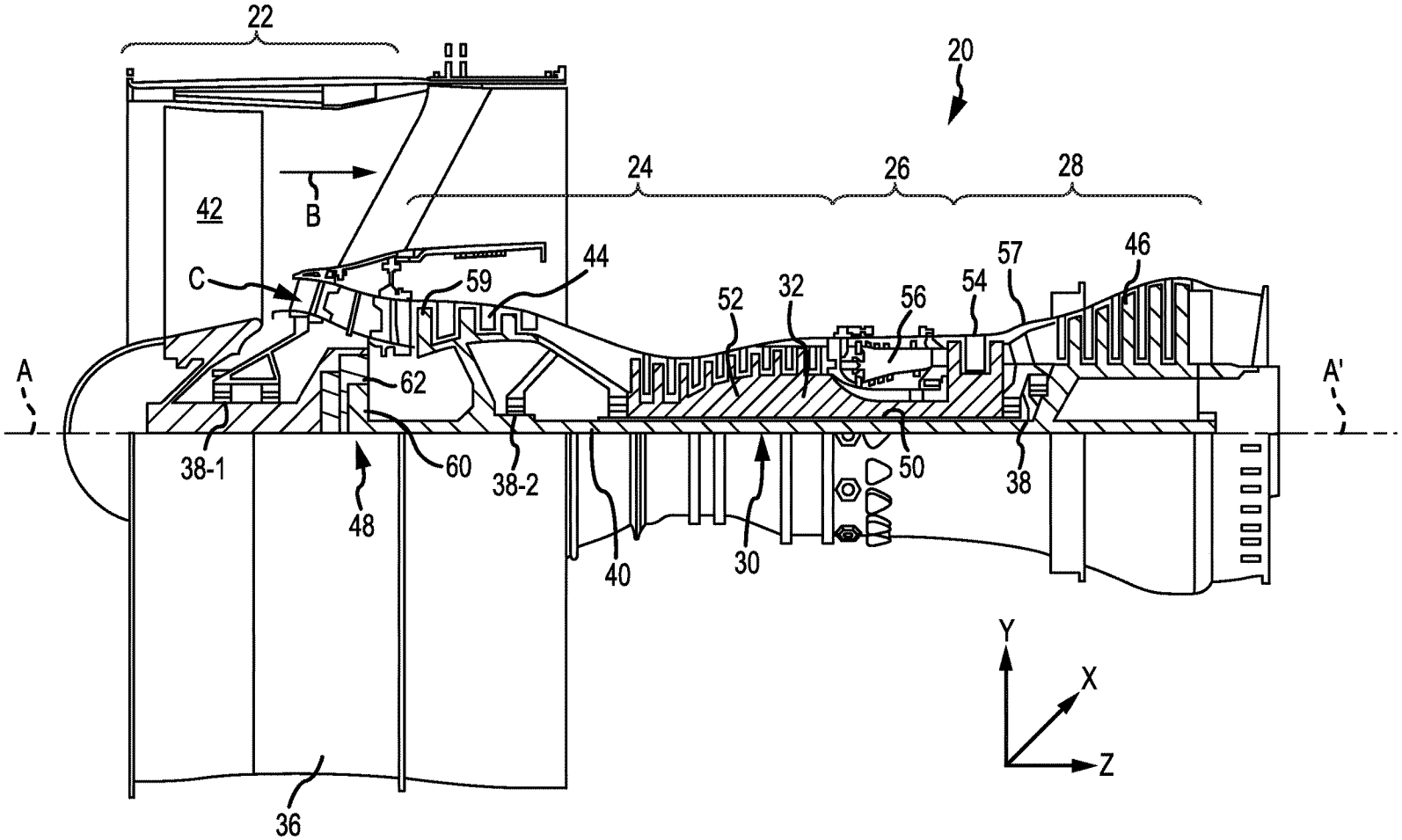
FIG. 1 illustrates a cross sectional view of a gas turbine engine, in accordance with various embodiments.

With reference to FIG. 1, a gas-turbine engine 20 is provided. Gas-turbine engine 20 may be a two-spool turbofan that generally incorporates a fan section 22, a compressor section 24, a combustor section 26 and a turbine section 28. Alternative engines may include, for example, an augmentor section among other systems or features. In operation, fan section 22 can drive coolant along a bypass flow-path B while compressor section 24 can drive coolant along a core flow-path C for compression and communication into combustor section 26 then expansion through turbine section 28. Although depicted as a turbofan gas-turbine engine 20 herein, it should be understood that the concepts described herein are not limited to use with turbofans as the teachings may be applied to other types of turbine engines including three-spool architectures.

Gas-turbine engine 20 may generally comprise a low speed spool 30 and a high speed spool 32 mounted for rotation about an engine central longitudinal axis A-A' relative to an engine static structure 36 via several bearing systems 38, 38-1, and 38-2. It should be understood that various bearing systems 38 at various locations may alternatively or additionally be provided, including for example, bearing system 38, bearing system 38-1, and bearing system 38-2.

Low speed spool 30 may generally comprise an inner shaft 40 that interconnects a fan 42, a low pressure compressor section 44 and a low pressure turbine section 46.

Inner shaft 40 may be connected to fan 42 through a geared architecture 48 that can drive fan 42 at a lower speed than low speed spool 30. Geared architecture 48 may comprise a gear assembly 60 enclosed within a gear housing 62. Gear assembly 60 couples inner shaft 40 to a rotating fan structure. High speed spool 32 may comprise an outer shaft 50 that interconnects a high pressure compressor 52 and high pressure turbine 54. A combustor 56 may be located between high pressure compressor 52 and high pressure turbine 54. Mid-turbine frame 57 may support one or more bearing systems 38 in turbine section 28. Inner shaft 40 and outer shaft 50 may be concentric and rotate via bearing systems 38 about the engine central longitudinal axis A-A', which is collinear with their longitudinal axes. As used herein, a "high pressure" compressor or turbine experiences a higher pressure than a corresponding "low pressure" compressor or turbine.

The core airflow C may be compressed by low pressure compressor section 44 then high pressure compressor 52, mixed and burned with fuel in combustor 56, then expanded over high pressure turbine 54 and low pressure turbine 46. Turbines 46, 54 rotationally drive the respective low speed spool 30 and high speed spool 32 in response to the expansion.

Gas-turbine engine 20 may be, for example, a high-bypass ratio geared aircraft engine. In various embodiments, the bypass ratio of gas-turbine engine 20 may be greater than about six (6). In various embodiments, the bypass ratio of gas-turbine engine 20 may be greater than ten (10). In various embodiments, geared architecture 48 may be an epicyclic gear train, such as a star gear system (sun gear in meshing engagement with a plurality of star gears supported by a carrier and in meshing engagement with a ring gear) or other gear system. Geared architecture 48 may have a gear reduction ratio of greater than about 2.3 and low pressure turbine 46 may have a pressure ratio that is greater than about five (5). In various embodiments, the bypass ratio of gas-turbine engine 20 is greater than about ten (10:1). In various embodiments, the diameter of fan 42 may be significantly larger than that of the low pressure compressor section 44, and the low pressure turbine 46 may have a pressure ratio that is greater than about five (5:1). Low pressure turbine 46 pressure ratio may be measured prior to inlet of low pressure turbine 46 as related to the pressure at the outlet of low pressure turbine 46 prior to an exhaust nozzle. It should be understood, however, that the above parameters are exemplary of various embodiments of a suitable geared architecture engine and that the present disclosure contemplates other turbine engines including direct drive turbofans.

Compressor section 24 includes airfoils 59, rotors and/or stators, in the path of core airflow C. During normal operation, core airflow C flows in the positive axial direction, as illustrated. Under operation a portion of the airfoil flow in the clearance region travels in the negative axial direction. Grooves formed in static and/or rotating structures radially adjacent airfoils 59 limit the amount of the clearance airflow moving in a negative axial direction at these conditions and improve stall capability and performance at various operating conditions.

Figure 2:
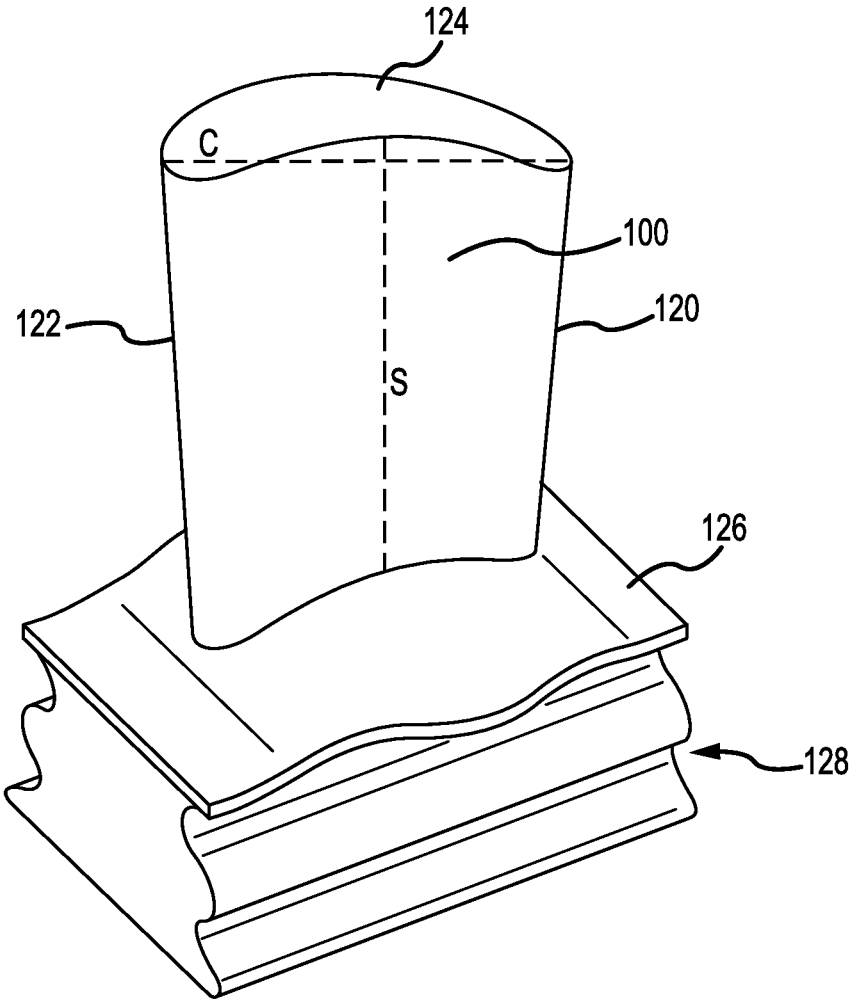
FIG. 2 illustrates a perspective view of an airfoil in a gas turbine engine, in accordance with various embodiments.

With reference to FIG. 2, an airfoil 100 is shown. Airfoil 100 comprises trailing edge 120 facing an aft direction in a gas turbine engine and leading edge 122 facing a forward direction in the gas turbine engine. Top 124 of airfoil 100 faces radially outward when airfoil 100 is installed in a rotating compressor section of a gas turbine engine. Platform 126 forms an inner boundary of a gas flow path in the gas turbine engine. Attachment 128 couples airfoil 100 to a rotor or stator. The chord at top 124 of airfoil 100 (i.e., the tip chord) is illustrated as chord C. The radial span of the airfoil, which is described as the length of the airfoil, is illustrated as span S.

Figure 3:
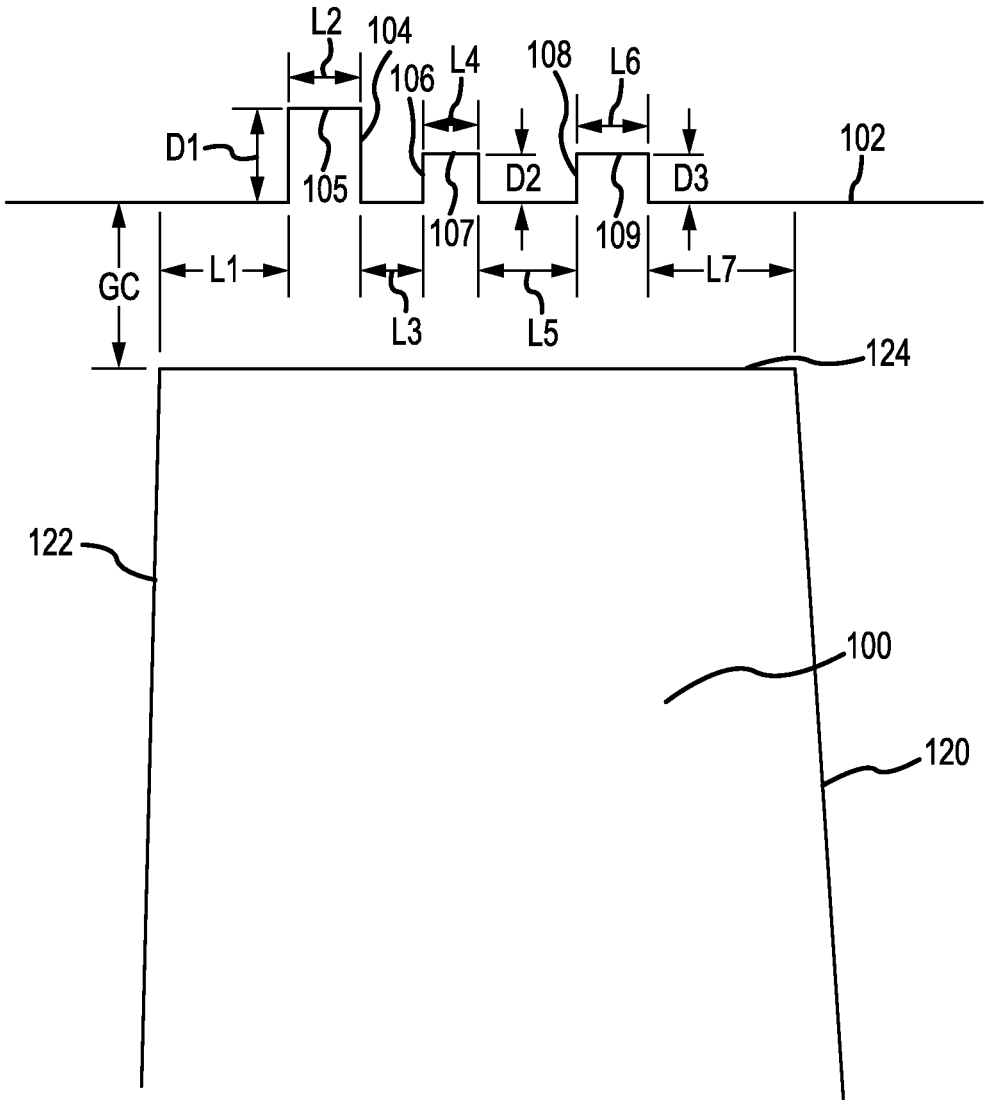
FIG. 3 illustrates an elevation view of airfoil and a static member with a gap clearance separating the airfoil and gap clearance, in accordance with various embodiments.

With reference to FIGS. 2 and 3, an airfoil 100 and a static member 102 are shown with a gap clearance GC separating top 124 of airfoil 100 and static member 102. Static member 102 is, for example, a fan case having a cylindrical wall or a stator vane having a gap clearance from a rotating member. The gap clearance between airfoil 100 and static member 102 are altered by forward groove 104, intermediate groove 106, and aft groove 108. The aforementioned grooves are selectively positioned in static member 102 to adjust stall margin and engine performance Forward groove 104 includes surface 105 with a depth D1 in static member 102. Intermediate groove 106 comprises surface 107 with depth D2 in static member 102. Aft groove 108 comprises surface 109 with a depth D3 in static member 102.

Forward groove 104 begins at a length L1 from the axial position located by the intersection of leading edge 122 and top 124. Forward groove 104 also has a length L2. A length L3 separates forward groove 104 and intermediate groove 106. Intermediate groove 106 has a length L4. A length of L5 separates intermediate groove 106 and aft groove 108. Aft groove 108 has a length L6. A length of L7 extends from the end of aft groove 108 to the axial position located by the intersection of trailing edge 120 and top 124 of airfoil 100.

The dimensions of forward groove 104, intermediate groove 106, and aft groove 108 are determined relative to the shape and size of airfoil 100. With reference to FIGS. 2 and 3, for example, airfoil 100 has a chord C and a span S. As for the lengths L1 through L7, each length has a distance related to the chord C. As used herein to describe lengths or distances, the term approximately refers to lengths or distances within a variance of +/−10%. For example, L1 is approximately 0.07 C, L2 is approximately 0.038 C, L3 is approximately 0.035 C, L4 is approximately 0.031 C, L5 is approximately 0.056 C, L6 is approximately 0.038 C, and L7 is approximately 0.077 C. Similarly, the depths D1 through D3 of forward groove 104, intermediate groove 106, and aft groove 108 are given in relation to span S. Distance D1 is approximately 0.11 S, distance D2 is approximately 0.055 S, and distance D3 is approximately 0.055 S. Although L2 and L6, and D2 and D3, are equal in this example, they may have different values in various embodiments.

The non-uniform aspect of the design of varied depth, axial spacing and axial extent of each groove are selectively sized to address aspects of the tip-clearance flow at two different operating conditions: Stall/near stall operating condition and standard operating conditions of the compressor. The placement and sizing of these grooves based upon features of the tip-clearance flow field ultimately result in the aforementioned non-uniform size and placement. This system utilizes two groups of grooves: the first group alters tip flow just prior to the stalling condition of the compressor. The first group comprises forward groove 104 and intermediate groove 106. The second group includes aft groove 108 to address tip flow at the standard operating condition. The geometries discussed refer to a 3 groove arrangement, but more or fewer grooves may be implemented in various embodiments. The grooves are utilized to address critical characteristics in the tip-clearance flow associated with negative axial velocity to enable improved capability at compressor near stall and typical operating condition and are discussed in conjunction with flow examples below A static member 102 (i.e., a compressor case) is configured to enclose an airfoil rotating about an axis. The compressor case comprises a cylindrical wall and a forward groove 104 formed circumferentially about the cylindrical wall of greatest depth D1. An intermediate groove 106 is formed circumferentially on the cylindrical wall aft of the forward groove 104, and an aft groove 108 is formed circumferentially on the cylindrical wall aft of intermediate groove 106. Intermediate groove 106 and aft groove 108 have equal depth. Forward groove 104 is deeper than intermediate groove 106 and aft groove 108. The length of the second groove L4 in an axial direction is lesser than the length L2 of forward groove 104 and length L6 of aft groove 108 in the axial direction.

Figure 4A:
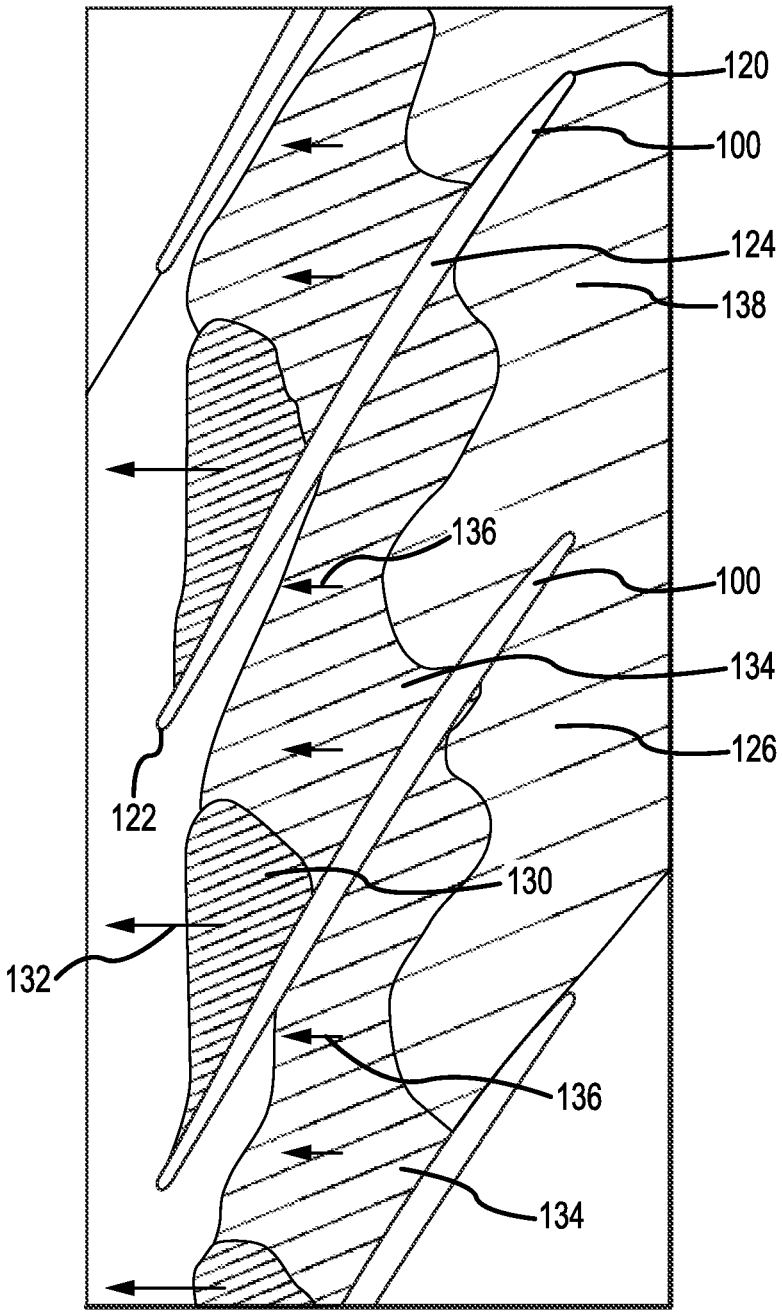
FIG. 4A illustrates tip leakage flow over an airfoil at an engine stall condition for selectively positioning and shaping of circumferential grooves, in accordance with various embodiments.
Figure 4B:
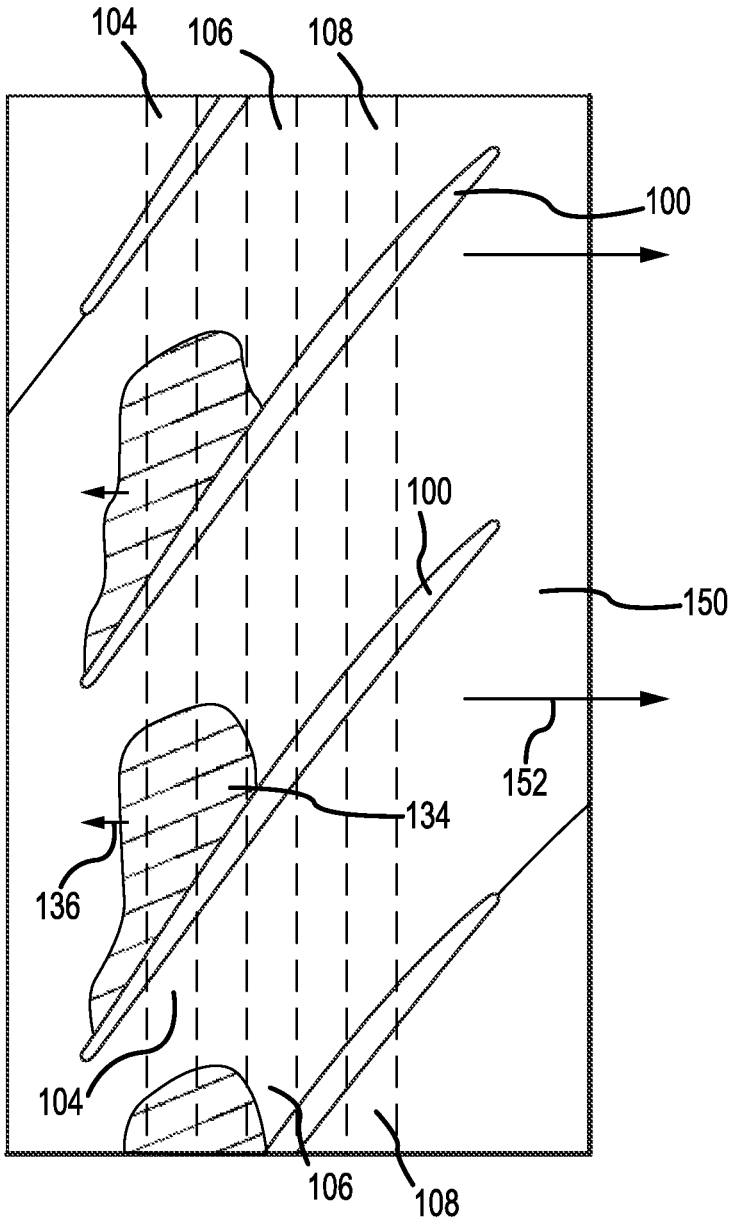
FIG. 4B illustrates tip leakage flow over an airfoil at an engine stall condition with a case treatment, according to various embodiments.

With reference to FIGS. 4A and 4B, a tip-leakage flow is shown over airfoil 100 at an engine stall condition, as viewed from above top 124 of airfoil 100. The tip-flow leakage may be modeled and analyzed, for example, using computational fluid dynamics (CFD). Under normal engine operation, air flow moves from forward to aft, and contacts a leading edge 122 of airfoil 100 and flows aft from trailing edge 120 of airfoil 100. The air flow illustrated in FIG. 4A, near a stall condition, includes portions flowing in a direction at least a partially forward from airfoil 100. The forward direction is also referred to as a negative axial direction. High negative axial velocity areas 130 have air flow with a greatest negative axial component 132. Additionally, negative axial velocity areas 134 include air flow with a negative axial component 136 of moderate velocity. Near neutral axial velocity areas have air flow with a neutral and/or near neutral axial component.

Case treatments may be formed in static components (e.g., compressor cases) to alter the air flow. The axial air velocities illustrated in FIGS. 4A and 4B are used to identify groove locations and selectively position grooves. A case treatment in a compressor section is selectively located on a static member by analyzing tip-clearance flow in the compressor section. The forward groove 104 is selectively located first by identifying a location of air flow with the greatest negative axial component 132 in the compressor operating at a near-stall condition. The forward groove 104 is formed through and/or adjacent to the location of peak negative air flow.

A second location of air flow is then identified after forward groove 104 is selectively positioned. The second location may be located using the same tip-leakage flow analysis as was used in locating forward groove 104, or using a tip-leakage flow analysis created with forward groove 104 disposed in the case. The tip-leakage flow used to identify the second location is analyzed at the near-stall condition. The second location of air flow is identified as the location with air flow having the negative axial component 136 of greatest velocity in the compressor operating near the stall condition. An intermediate groove 106 is formed aft of the forward groove 104 through and/or adjacent the second location of air flow. Intermediate groove 106 is spaced from forward groove 104 by a distance in the axial direction, i.e., length L3 of FIG. 2. Both forward groove 104 and intermediate groove 106 are selectively placed using analytics at a near stall condition, and additional grooves may be formed is further alteration of tip-leakage flow characteristics is desired.

Tip-leakage flow is analyzed after placement of intermediate groove 106. If the magnitude of the total negative axial velocity of the clearance region (i.e., the between rotating airfoils 100 and static member 102 of FIG. 3) is not reduced by 30%, one or more additional groove is placed using analytics at the near stall condition. The segment of static member 102 between adjacent grooves defines a tooth separating the grooves. For additional grooves, a minimum ratio of tooth width/groove width is 0.8. Referring briefly to FIG. 3 to provide an example, L3 between forward groove 104 and intermediate groove 106 is the tooth width and L4 of intermediate groove 106 is a groove width, where L3/L4 is chosen to be greater than or equal to 0.8.

After forward groove 104 and intermediate groove 106 are formed using, one or more aft groove 108 is formed. Aft groove 108 is formed using tip-leakage flow analytics of the compressor at a normal operating condition with the forward groove 104 and intermediate groove 106 formed. A location for aft groove 108 is selected by evaluated air flow at the normal operating condition of the compressor. The location is identified by finding the location of the air flow with greatest negative axial velocity at the normal operating condition. An aft groove 108 is formed aft of the intermediate groove 106. The third circumferential groove is selectively placed through and/or adjacent the location of air flow with the greatest negative axial velocity at the normal operating condition. If flow magnitude is not reduced by a desired amount, e.g., 50%, additional grooves are selectively placed using the same approach used to place aft groove 108. The positions of forward groove 104, intermediate groove 106, and aft groove 108 increase the positive axial velocity of air at near stall conditions and also improve efficiency. As a result, the optimized grooves increase the stall margin of an engine while also increasing engine efficiency.

The depth of each groove at the relevant operating condition is also selected based on tip-leakage flow analysis. The first group of grooves, including forward groove 104 and intermediate groove 106 in FIG. 4B, is evaluated at the near stall condition. The second group of grooves, including aft groove 108 in FIG. 4B, is evaluated at a normal operating condition. The depth of each groove is selected starting with a ratio of width/depth ≥0.4. The groove flow in each groove is analyzed and the depth adjusted so that some amount of negative axial velocity air flow must be present up to 75% of the groove depth. If 75% of the groove depth does not contain flow with at least a partial negative axial velocity, then the groove depth is reduced until 75% of the groove depth does contain some negative axial velocity flow. This is completed for each groove individually at the flow condition specified for the identified groove groups.

Benefits, other advantages, and solutions to problems have been described herein with regard to specific embodiments. The scope of the disclosure, however, is provided in the appended claims.

The detailed description of exemplary embodiments herein makes reference to the accompanying drawings, which show exemplary embodiments by way of illustration. While these exemplary embodiments are described in sufficient detail to enable those skilled in the art to practice the exemplary embodiments of the disclosure, it should be understood that other embodiments may be realized and that logical changes and adaptations in design and construction may be made in accordance with this disclosure and the teachings herein. Thus, the detailed description herein is presented for purposes of illustration only and not limitation. The scope of the disclosure is defined by the appended claims. For example, the steps recited in any of the method or process descriptions may be executed in any order and are not necessarily limited to the order presented.

As used herein, "aft" refers to the direction associated with the tail/back of an aircraft, or generally, to the direction of exhaust of the gas turbine. As used herein, "forward" refers to the direction associated with the nose/front of an aircraft, or generally, to the direction of flight or motion.

As used herein, "distal" refers to the direction radially outward, or generally, away from the axis of rotation of a turbine engine. As used herein, "proximal" refers to a direction radially inward, or generally, towards the axis of rotation of a turbine engine.

What is claimed is:

1. A compressor, comprising:

a rotating member configured to rotate about an axis;

a static member radially adjacent the rotating member with a clearance between the static member and the rotating member;

a first groove disposed circumferentially about the static member and radially adjacent the rotating member, wherein the first groove is formed in a first location corresponding to airflow having a greatest negative axial velocity at a near-stall condition;

a second groove disposed circumferentially about the static member and a first axial distance aft of the first groove, wherein the second groove is formed in a second location corresponding to airflow having a second negative axial velocity at the near-stall condition, wherein the second negative axial velocity is less than the greatest negative axial velocity at the near-stall condition; and a third groove disposed circumferentially about the static member and a second axial distance aft of the second groove, wherein the first axial distance is different from the second axial distance and wherein the third groove is formed in a third location corresponding to airflow with a greatest negative axial velocity at a standard operating condition, wherein an axial length of the first groove is greater than an axial length of the second groove and equal to an axial length of the third groove.

2. The compressor of claim 1, wherein a depth of the first groove is greater than a depth of the second groove.

3. The compressor of claim 1, wherein the static member comprises a stator vane.

4. The compressor of claim 1, wherein the rotating member comprises an airfoil and the static member comprises a case adjacent the airfoil.

5. The compressor of claim 4, wherein the axial length of the first groove is approximately 0.038 times a length of a tip chord of the airfoil.

6. The compressor of claim 5, wherein a depth of the first groove is approximately 0.11 times a span of the airfoil.

7. The compressor of claim 5, wherein the axial length of the second groove is approximately 0.031 times the length of the tip chord.

8. The compressor of claim 7, wherein a depth of the second groove is approximately 0.055 times a span of the airfoil.

9. The compressor of claim 4, wherein a depth of the third groove is approximately 0.055 times a span of the airfoil.

10. The compressor of claim 1, wherein a ratio of the first axial distance over the axial length of the second groove is greater than or equal to 0.8.

11. A method of locating a case treatment in a compressor section, comprising:

measuring a velocity of a negative axial airflow over an airfoil at a near-stall condition;

identifying a first location corresponding to airflow with a greatest negative axial velocity at the near-stall condition;

forming a first circumferential groove adjacent or through the first location, wherein the first circumferential groove is radially outward from the airfoil;

identifying a second location corresponding to airflow over the airfoil with a second negative axial velocity at the near-stall condition, wherein the second negative axial velocity is less than the greatest negative axial velocity at the near-stall condition;

forming a second circumferential groove aft of the first circumferential groove and adjacent or through the second location, wherein the second circumferential groove is radially outward from the airfoil;

determining if the greatest negative axial velocity at the near-stall condition is reduced by at least 30%, after forming the first circumferential groove and the second circumferential groove;

measuring the velocity of the negative axial airflow over the airfoil at a standard operating condition, after forming the first circumferential groove and the second circumferential groove and after the determining if the greatest negative axial velocity at the near-stall condition is reduced by at least 30%;

identifying a third location corresponding to airflow with a greatest negative axial velocity at the standard operating condition; and forming a third circumferential groove aft of the second circumferential groove and adjacent or through the third location.

12. The method of claim 11, wherein the second location is identified after the first circumferential groove is formed.

13. The method of claim 11, wherein a depth of the third circumferential groove is substantially equal to a depth of the second circumferential groove.

14. The method of claim 11, wherein an axial length of the third circumferential groove is greater than an axial length of the second circumferential groove.

15. The method of claim 14, wherein the axial length of the third circumferential groove is equal to an axial length of the first circumferential groove.

16. The method of claim 11, wherein an axial length of the first circumferential groove is approximately 0.038 times a length of a tip chord of the airfoil, and wherein an axial length of the second circumferential groove is approximately 0.031 times the length of the tip chord.

17. The method of claim 16, wherein a depth of the first circumferential groove is approximately 0.11 times a span of the airfoil.

18. A method of locating a case treatment in a compressor section, comprising:

measuring a velocity of a negative axial airflow at a near-stall condition;

selecting a first location for a first circumferential groove based on the velocity of the negative axial airflow at the near-stall condition, wherein the first location corresponds to airflow with a greatest negative axial velocity at the near-stall condition;

forming the first circumferential groove at the first location;

selecting a second location for a second circumferential groove based on the velocity of the negative axial airflow at the near-stall condition;

forming the second circumferential groove at the second location;

measuring the velocity of the negative axial airflow at a standard operating condition, after the forming the first circumferential groove and the forming the second circumferential groove; and selecting a third location for a third circumferential groove based on the velocity of the negative axial airflow at the standard operating condition, wherein the third location corresponds to airflow with a greatest negative axial velocity at the standard operating condition.

19. The method of claim 18, further comprising determining if the greatest negative axial velocity at the near-stall condition is reduced by a desired amount, after forming the first circumferential groove and the second circumferential groove.

20. The method of claim 19, wherein the desired amount is 30%.

* * * * *